US011442388B2

(12) United States Patent
Yokote

(10) Patent No.: US 11,442,388 B2
(45) Date of Patent: Sep. 13, 2022

(54) IMAGE FORMING APPARATUS

(71) Applicant: CANON KABUSHIKI KAISHA, Tokyo (JP)

(72) Inventor: Akihito Yokote, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/209,538

(22) Filed: Mar. 23, 2021

(65) Prior Publication Data

US 2021/0302886 A1 Sep. 30, 2021

(30) Foreign Application Priority Data

Mar. 24, 2020 (JP) ..... JP2020-053142

(51) Int. Cl.
*G03G 15/00* (2006.01)

(52) U.S. Cl.
CPC ..... *G03G 15/5062* (2013.01)

(58) Field of Classification Search
CPC ..... G03G 15/5062
See application file for complete search history.

(56) References Cited

U.S. PATENT DOCUMENTS 10,827,101 B2 * 11/2020 Hashimoto ..... H04N 1/6041
2017/0153586 A1 * 6/2017 Tanaka ..... G03G 15/5062
2017/0153588 A1 * 6/2017 Tanaka ..... G03G 15/043
2018/0356759 A1 * 12/2018 Narita ..... G03G 15/5062
2019/0064694 A1 * 2/2019 Nagai ..... G03G 15/04072
2021/0041822 A1 2/2021 Yokote
2021/0150290 A1 5/2021 Yokote

FOREIGN PATENT DOCUMENTS

JP 2006-343679 A 12/2006
JP 2011145350 A * 7/2011
JP 2012155042 A * 8/2012 ..... G03G 15/5058

* cited by examiner

*Primary Examiner* — Sevan A Aydin
(74) *Attorney, Agent, or Firm* — Venable LLP

(57) ABSTRACT

In an image forming apparatus, an image processing unit converts image data based on a plurality of conversion conditions corresponding to a plurality of positions in a predetermined direction. A controller controls an image forming unit to form an image based on the image data converted by the image processing unit, and controls the image forming unit to form a plurality of pattern images including first, second and third pattern images. The controller controls a reading unit to read the plurality of pattern images on the sheet, generates correction conditions corresponding to the plurality of positions in the predetermined direction based on a reading result of the reading unit, and generates the plurality of conversion conditions based on the reading result and the correction conditions corresponding to the plurality of positions in the predetermined direction.

6 Claims, 9 Drawing Sheets

FIG. 6

| TONE LEVEL | INPUT IMAGE SIGNAL (10bit) | OUTPUT DENSITY (10bit) |
|---|---|---|
| TONE LEVEL 4 | 895 | 620 |
| TONE LEVEL 3 | 703 | 385 |
| TONE LEVEL 2 | 511 | 285 |
| TONE LEVEL 1 | 319 | 212 |

| GRADIENT a |
|---|
| 1.22 |
| 0.87 |
| 0.45 |
| 0.38 |

| COEFFICIENT N |
|---|
| 0.82 |
| 1.15 |
| 2.22 |
| 2.63 |

FIG. 8A

| NORMAL PAPER | COEFFICIENT N | | | |
|---|---|---|---|---|
| | Y | M | C | K |
| TONE LEVEL 4 | 0.82 | 0.82 | 0.82 | 0.82 |
| TONE LEVEL 3 | 1.15 | 1.15 | 1.15 | 1.15 |
| TONE LEVEL 2 | 2.22 | 2.22 | 2.22 | 2.22 |
| TONE LEVEL 1 | 2.63 | 2.63 | 2.63 | 2.63 |

FIG. 8B

| THICK PAPER | COEFFICIENT N | | | |
|---|---|---|---|---|
| | Y | M | C | K |
| TONE LEVEL 4 | 0.87 | 0.87 | 0.87 | 0.87 |
| TONE LEVEL 3 | 1.18 | 1.18 | 1.18 | 1.18 |
| TONE LEVEL 2 | 1.96 | 1.96 | 1.96 | 1.96 |
| TONE LEVEL 1 | 2.38 | 2.38 | 2.38 | 2.38 |

FIG. 8C

| COATED PAPER | COEFFICIENT N | | | |
|---|---|---|---|---|
| | Y | M | C | K |
| TONE LEVEL 4 | 0.87 | 0.87 | 0.87 | 0.87 |
| TONE LEVEL 3 | 1.11 | 1.11 | 1.11 | 1.11 |
| TONE LEVEL 2 | 1.89 | 1.89 | 1.89 | 1.89 |
| TONE LEVEL 1 | 2.22 | 2.22 | 2.22 | 2.22 |

IMAGE FORMING APPARATUS

BACKGROUND OF THE INVENTION

Field of the Invention

The present invention relates to a correction process of correcting density unevenness of an image formed by an image forming apparatus.

Description of the Related Art

In an electrophotographic image forming apparatus, there may occur variation in tint of an output image due to, for example, variation in use environment such as temperature and humidity, performance degradation caused by aging or reduced durability of members. In addition, sensitivity unevenness on a photosensitive drum, edge drop of an amount of laser light emitted onto the photosensitive drum, lens aberration of an optical system being used, uneven transfer during a transfer process, or the like, may cause density unevenness or color unevenness in an output image. Generally, density unevenness or color unevenness appearing in the main scanning direction may have a larger impact on the output image than that appearing in the sub scanning direction.

In order to correct density unevenness generated in the main scanning direction in the output image described above, it is necessary to measure the density unevenness to be corrected with a high accuracy. Japanese Patent Laid-Open No. 2006-343679 discloses a technique for correcting density unevenness in a main scanning direction while reducing the effect of density unevenness in a sub scanning direction, by forming a plurality of density patterns at a predetermined interval based on a periphery length of a photosensitive member or the like, and deriving a correction value for each density pattern.

The aforementioned conventional technique derives a correction value from a detection result of a density pattern and, using the derived correction value, corrects the density unevenness generated in the main scanning direction in the output image. However, density unevenness cannot be suppressed with a high accuracy unless the correction value is an appropriate value.

SUMMARY OF THE INVENTION

Accordingly, the present invention provides a technique for suppressing density unevenness with a high precision.

According to one aspect of the present invention, there is provided an image forming apparatus, comprising: an image forming unit that includes: a photosensitive member that rotates; a charging unit configured to charge the photosensitive member; an exposure unit configured to expose the photosensitive member charged by the charging unit to form an electrostatic latent image on the photosensitive member; and a developing unit configured to develop the electrostatic latent image on the photosensitive member, an image processing unit configured to convert image data based on a plurality of conversion conditions corresponding to a plurality of positions in a predetermined direction orthogonal to a rotation direction of the photosensitive member; a reading unit configured to read a pattern image formed on a sheet; and a controller configured to: control the image forming unit to form an image based on the image data converted by the image processing unit; control the image forming unit to form a plurality of pattern images including a first pattern image, a second pattern image, and a third pattern image, wherein the first pattern image corresponds to first pattern image data, the second pattern image corresponds to second pattern image data different from the first pattern image data, and the third pattern image corresponds to third pattern image data different from both of the first pattern image data and the second pattern image data; control the reading unit to read the plurality of pattern images on the sheet; generate correction conditions corresponding to the plurality of positions in the predetermined direction based on a reading result of the reading unit; and generate the plurality of conversion conditions based on the reading result of the reading unit and the correction conditions corresponding to the plurality of positions in the predetermined direction.

Further features of the present invention will become apparent from the following description of exemplary embodiments (with reference to the attached drawings).

BRIEF DESCRIPTION OF THE DRAWINGS

FIG. 6 illustrates an example of acquisition of conversion coefficients N;

FIGS. 8A to 8C illustrate examples of conversion coefficient tables according to a second embodiment.

DESCRIPTION OF THE EMBODIMENTS

Figure 1:
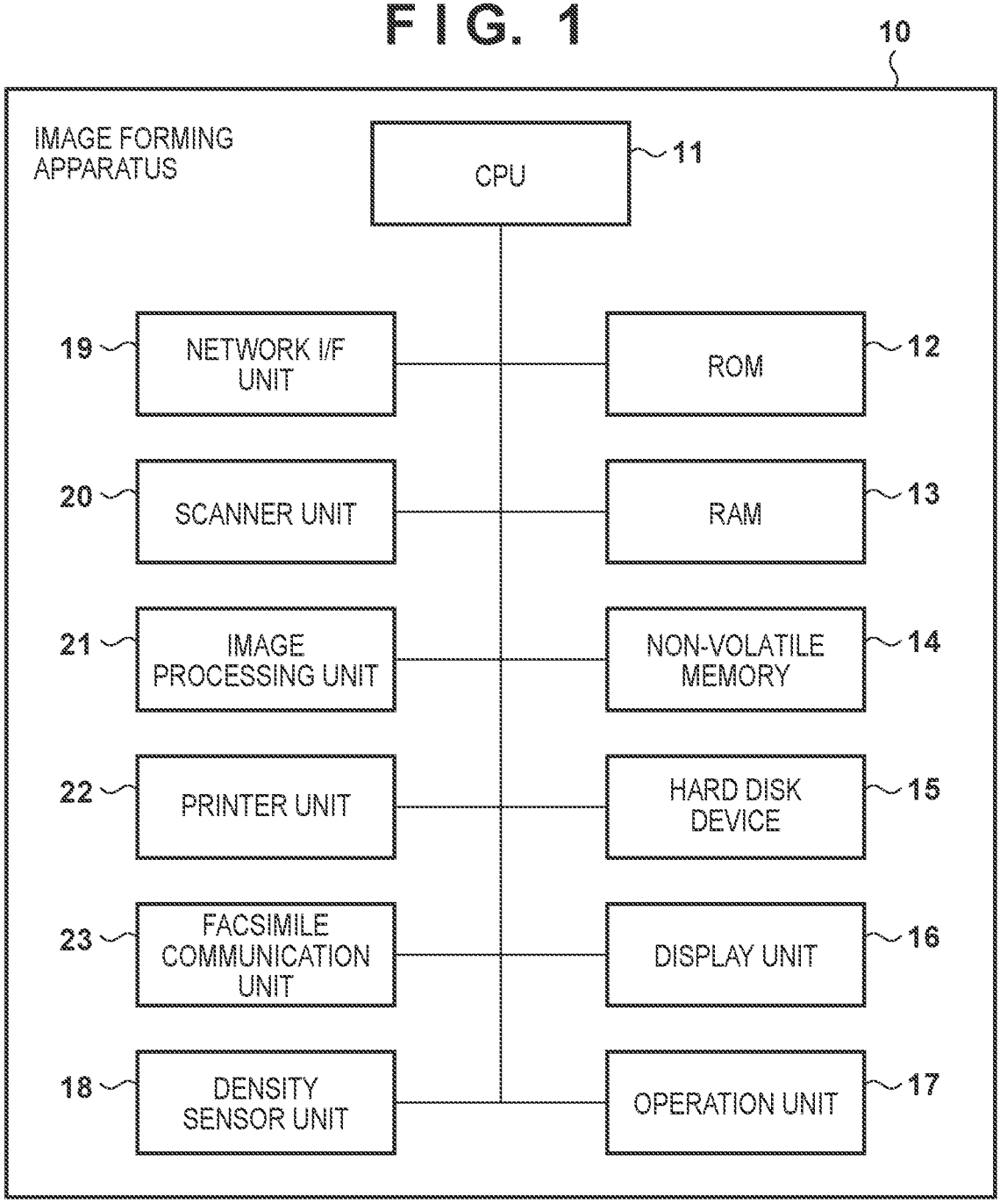
FIG. 1 is a block diagram illustrating a general configuration example of an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

FIRST EMBODIMENT

<Image Forming Apparatus>

FIG. 1 is a block diagram illustrating a general hardware configuration example of an image forming apparatus 10 according to a first embodiment. The image forming apparatus 10, including an image forming function (print function) of performing image formation on a printing material such as a printing sheet, is configured as a multi-function peripheral (MFP) having a function of performing various jobs such as copying, scanning, printing, or the like. A copy job is a job that optically reads an image of a document and prints a copy of the image on a printing sheet. A scan job is a job that optically reads an image of a document and stores, or transmits to an external device, the acquired image data as a file. A print job is a job that prints an image on a sheet, based on image data (print data) received from an external device such as a PC. The image forming apparatus 10 may be configured as a printing apparatus, a printer, a copying machine, or a facsimile machine, for example. Note that, in the following, a direction in which a sheet used for image formation moves along the conveyance path (i.e., sheet conveyance direction) in the image forming apparatus 10 is referred to as a sub scanning direction, and a direction orthogonal to the sheet conveyance direction is referred to as a main scanning direction.

As illustrated in FIG. 1, the image forming apparatus 10 includes a CPU 11, a ROM 12, a RAM 13, a non-volatile memory 14, a hard disk device 15, a display unit 16, an operation unit 17, density sensor unit 18, a network OF (interface) unit 19, a scanner unit 20, an image processing unit 21, a printer unit 22, and a facsimile communication unit 23. The printer unit 22 is an example of an image forming unit configured to form an image on a sheet based on image data.

The CPU 11 controls the overall operation of the image forming apparatus 10 by executing various programs such as middle-ware and application programs on an underlying OS (operating system) program. The ROM 12 has stored therein various programs such as a control program. The CPU 11 implements various functions of the image forming apparatus 10 by executing the programs stored in the ROM 12. The CPU 11 derives a correction value for correcting density unevenness that occurs in an image output from the printer unit 22 and generates, based on the derived correction value, an LUT (lookup table) for correcting an image signal value for image formation. The image processing unit 21 converts the image signal value based on the aforementioned LUT, and forms an image based on the image signal value converted by the printer unit 22, so that the density of the image formed on the sheet by the image forming apparatus 10 is controlled to stay close to a target density. The RAM 13 is used as a work memory for temporarily storing various data when the CPU 11 executes a program, or as an image memory that allows the CPU 11 to store image data.

The non-volatile memory 14 is a rewritable memory (flash memory) that can keep holding the content of storage even after the image forming apparatus 10 is powered off. The non-volatile memory 14 stores, for example, device-specific information, and various configuration information. The hard disk device 15 is a non-volatile storage device having a larger capacity than the non-volatile memory 14. The hard disk device 15 stores various programs such as the OS program and application programs, as well as various data such as image data, and data including job-related historical information.

The display unit 16, including a liquid crystal display (LCD), for example, has a function of displaying various screens such as an operation screen. The operation unit 17 has a function of accepting, from a user, various operations for job entry, change of setting, or the like. The operation unit 17 may include, for example, a touch panel, a numeric keypad, character entry keys, a start key, or the like.

The network I/F unit 19 communicates with external devices such as a PC connected via a network such as a wired or wireless LAN. The facsimile communication unit 23 performs facsimile transmission to, or reception from, an external device. The image processing unit 21 converts image data based on an LUT (lookup table) for each position in the main scanning direction, and outputs the converted image data to the printer unit 22. In addition, the image processing unit 21 performs various types of image processing such as magnification, reduction or rotation of an image, a rasterization process that converts image data (print data) into bitmap-formatted image data, a compression or expansion process of image data, or the like.

The scanner unit 20 has a function of optically reading an image of a document to generate image data. The scanner unit 20 may include, for example, a light source that illuminates a document, a line image sensor that receives light reflected from the document to read an image of the document in the width direction (main scanning direction) line by line (main scanning line), and a movement mechanism for moving the reading position of the image line by line. The scanner unit 20 may further include an optical system including a lens, a mirror or the like for guiding the light reflected from the document to the line image sensor to form an image thereon, and a conversion unit that converts analog image signals output from the line image sensor into digital image data.

The printer unit 22 has a function of printing (forming) an image on the sheet based on the input image data. The printer unit 22 is configured as a laser printer that performs electrophotographic image formation. The printer unit 22 includes a sheet conveyance mechanism, a photosensitive drum serving as a photosensitive member, a charging device, a laser unit, a developing device, a transfer device, a cleaning device, a fixing device, or the like. The laser unit (exposure unit) exposes the photosensitive drum based on the image data in order to form an electrostatic latent image on the photosensitive drum. The developing device (developing unit), including a developing sleeve that rotates while carrying developer, and a conveying screw that conveys the developer in the developing device while stirring the developer, uses the developer to develop the electrostatic latent image formed on the photosensitive drum. The printer unit 22 forms a two-dimensional image on the sheet by repeating image formation line by line, while moving the forming position of the image of one line that is along the main scanning direction into the sub scanning direction.

The density sensor unit 18 is a sensor used to measure the density of the image (toner image) formed on the sheet. In the present embodiment, the density sensor unit 18 is used for measuring the density distribution with regard to the measurement chart output (printed) by the printer unit 22 (measurement chart 30 in FIG. 2). The density sensor unit 18 includes, for example, red, green and blue LED light sources, and a photodiode (PD) that receives reflected light of the light emitted from the LED light sources. The CPU 11 can measure density of an image, by converting a voltage output from the PD into a density value by referring to a density conversion table. Note that density of the image formed on the sheet may be measured using the scanner unit 20 instead of the density sensor unit 18.

<Correction of Density Unevenness in Output Image>

Figure 2:
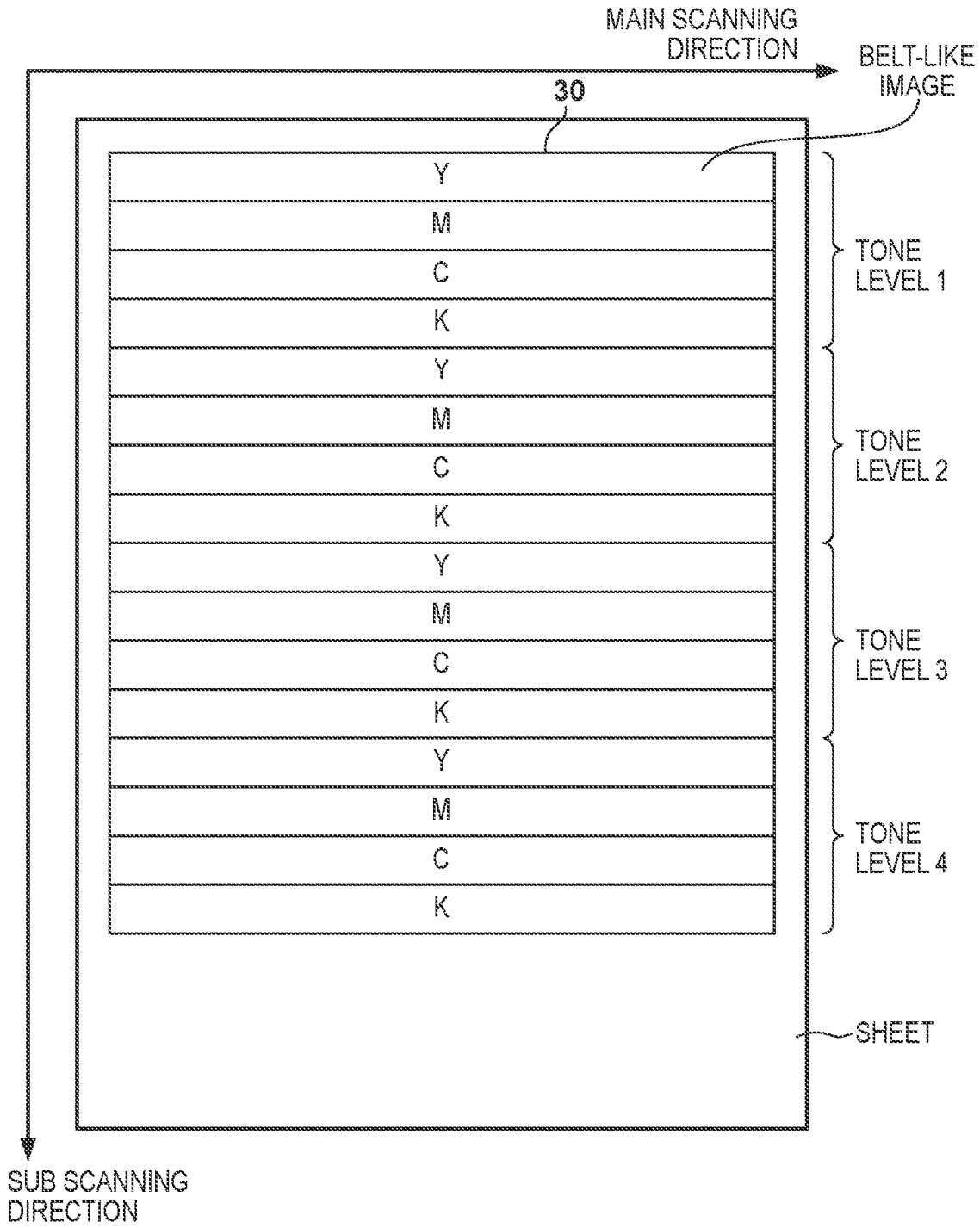
FIG. 2 illustrates an example of a measurement chart.

FIG. 2 illustrates an example of a measurement chart used in the image forming apparatus 10. The measurement chart 30 is a chart image for detecting density unevenness. The chart image is configured to include a plurality of belt-like images respectively corresponding to different tone levels, the plurality of belt-like images being formed across an image forming region in the main scanning direction, and arranged in parallel in the sub scanning direction that is orthogonal to the main scanning direction. Details of the measurement chart 30 will be described later.

The image forming apparatus 10 causes the printer unit 22 to print the measurement chart 30 as illustrated in FIG. 2 on a sheet, and causes the density sensor unit 18 to measure the density distribution on the measurement chart. The image forming apparatus 10 detects, based on the measured density distribution, density unevenness in the main scanning direction, that occurred in the measurement chart 30 formed on the sheet, and generates a plurality of conversion conditions for correcting the density unevenness that occurs during image formation by the printer unit 22. The plurality of conversion conditions are equivalent to conversion conditions that correspond to a plurality of positions in the main scanning direction (predetermined direction) orthogonal to the rotation direction of the photosensitive drum. Furthermore, the image forming apparatus 10 corrects the input image data (input image signal values) based on the plurality of generated conversion conditions.

In the present embodiment, the image forming apparatus 10 derives a density difference ΔD to be corrected in order to correct density unevenness in the main scanning direction (density unevenness correction) for each region in the main scanning direction, based on the measurement result of the density distribution on the measurement chart 30. The density difference ΔD is a difference between the target density (target value) of a belt-like image and a density value of each region (each representative position) in the main scanning direction. In other words, the density difference ΔD represents the density unevenness that occurred in the output image. Note that the target density is determined as an average value of the densities derived from respective regions in the main scanning direction of a belt-like image. The target density is not limited to the average density, and the density at an arbitrary position in the main scanning direction may be chosen as the target density, for example. The image forming apparatus 10 further uses the conversion coefficient N to convert the density difference ΔD into a correction amount for correcting the input image data (input image signal values). The conversion coefficient N represents correction data indicating the degree to which the density of the output image varies (i.e., the variation amount of the density value of the output image relative to the variation amount of the signal value of the input image data) in a case where the signal value of the input image data has been varied by a certain amount. Depending on the conversion coefficient N, the correction accuracy of the density unevenness that occurred in the output image varies. Note that the correction data is not limited to a coefficient (conversion coefficient N). The correction data may be a table indicating a correspondence between the density difference ΔD and the correction amount. When using a table as correction data, the correction amount of the input image signal value is derived from the density difference ΔD based on the table.

Figure 3:
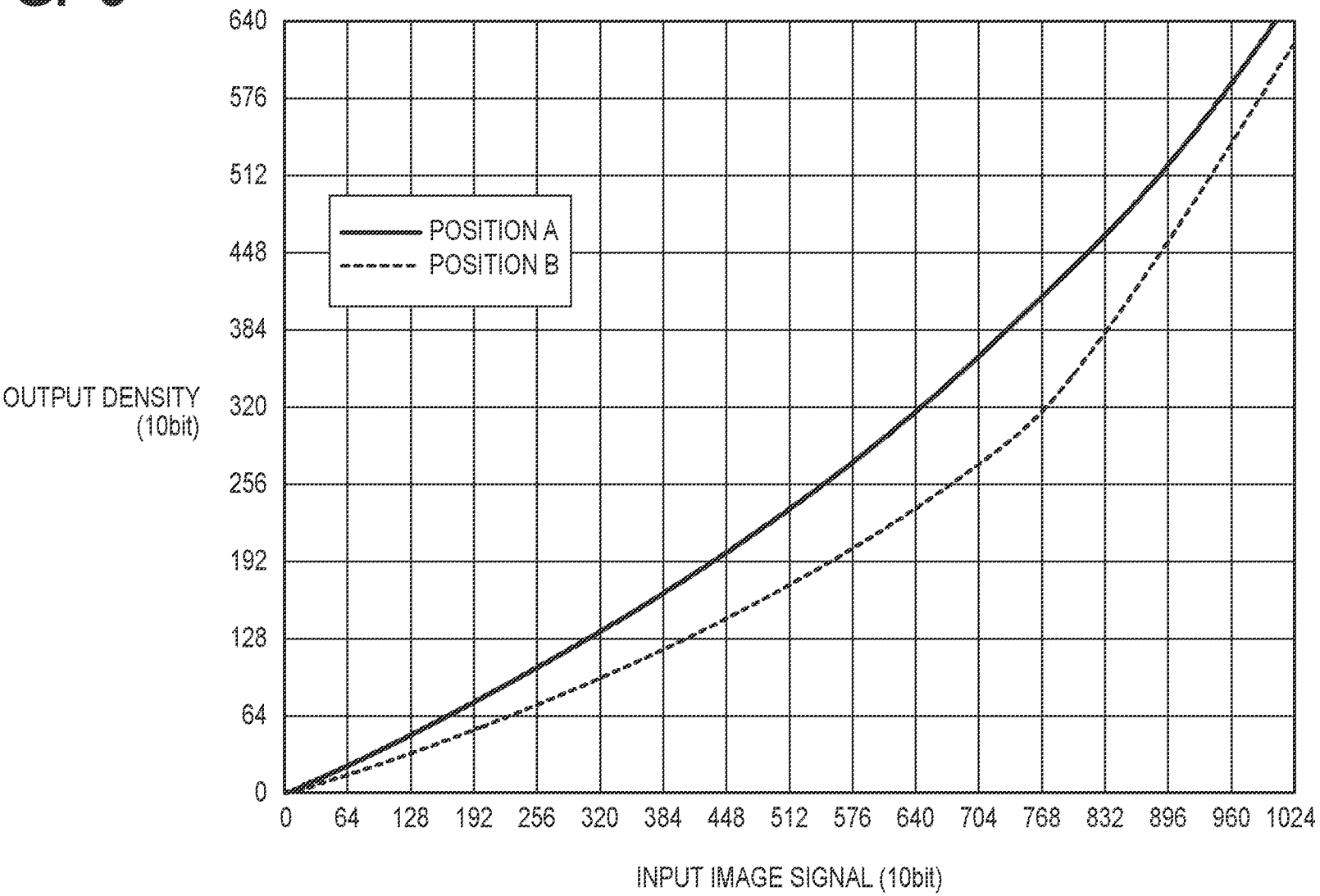
FIG. 3 illustrates an example of a tone characteristic indicating a relation between input image signal and output density.

FIG. 3 illustrates an example of a tone characteristic indicating the relation between the input image signal and the density of the output image (output density), and also indicating the tone characteristic at two different positions (position A and position B) in the main scanning direction. As illustrated in FIG. 3, image formation by the printer unit 22 may form an image with the tone characteristic being different for each position in the main scanning direction. In the present example, the tone characteristic at the position A exhibits a generally larger gradient than the tone characteristic at the position B. The foregoing indicates that, when an identical input image signal value (e.g., 512) is corrected with an identical correction amount for positions A and B, the variation amount of the output density at position A turns out to be larger than the variation amount of the output density at position B. Here, the image forming apparatus 10 derives the correction amount of the input image signal according to the following equation.

$$\text{Correction amount} = \text{density difference } \Delta D \times \text{conversion coefficient } N \quad (1)$$

In the present embodiment, the correction amount of the input image signal is determined by multiplying, by the conversion coefficient N for each tone level, the density difference ΔD for each tone level at each position in the main scanning direction.

According to the aforementioned equation (1), predetermining an excessively large conversion coefficient N results in an excessively large correction amount of the input image signal, which may lead to over-correction of density unevenness. On the other hand, predetermining an excessively small conversion coefficient N results in an excessively small correction amount of the input image signal, which may lead to under-correction of density unevenness. Accordingly, in order to increase the correction accuracy of density unevenness that occurs in the output image in the main scanning direction, it is necessary to derive an appropriate correction amount for the input image signal by setting an appropriate value to the conversion coefficient N in accordance with the tone characteristic of the printer unit 22, as illustrated in FIG. 3.

In addition, as illustrated in FIG. 3, the gradient of the tone characteristic differs from one density range to another, for each of the positions A and B. The foregoing indicates that, even if the input image signal is corrected by an identical correction amount for an identical position in the main scanning direction, it results in different variation amounts of the output density for respective density ranges. Accordingly, the conversion coefficient N for determining the correction amount of the input image signal needs to be appropriately set for each density range.

Figure 4A:
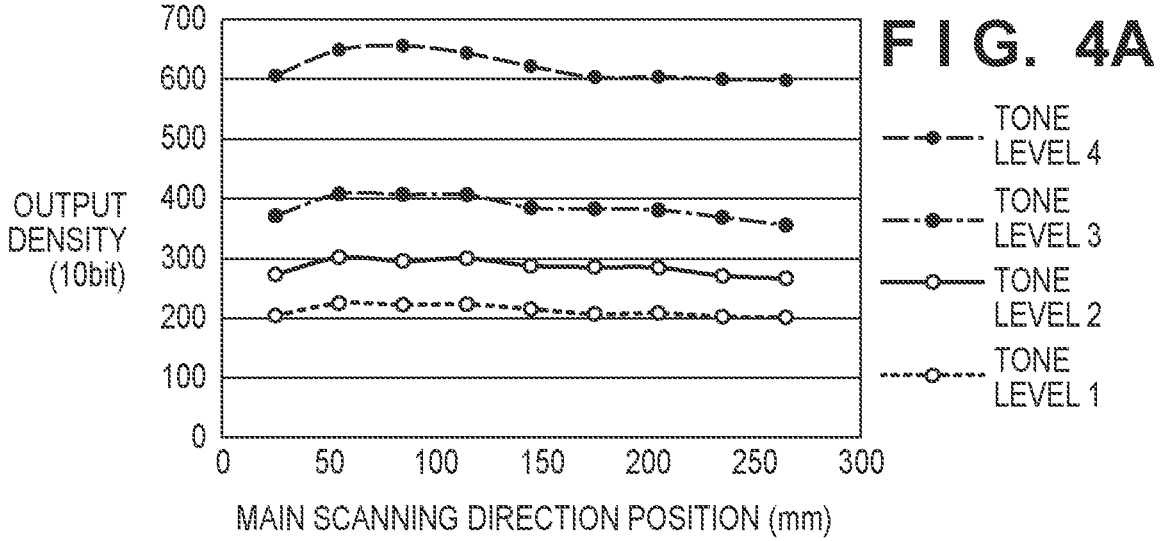
FIGS. 4A to 4C illustrate examples of density distribution acquired by measurement using the measurement chart.
Figure 4B:
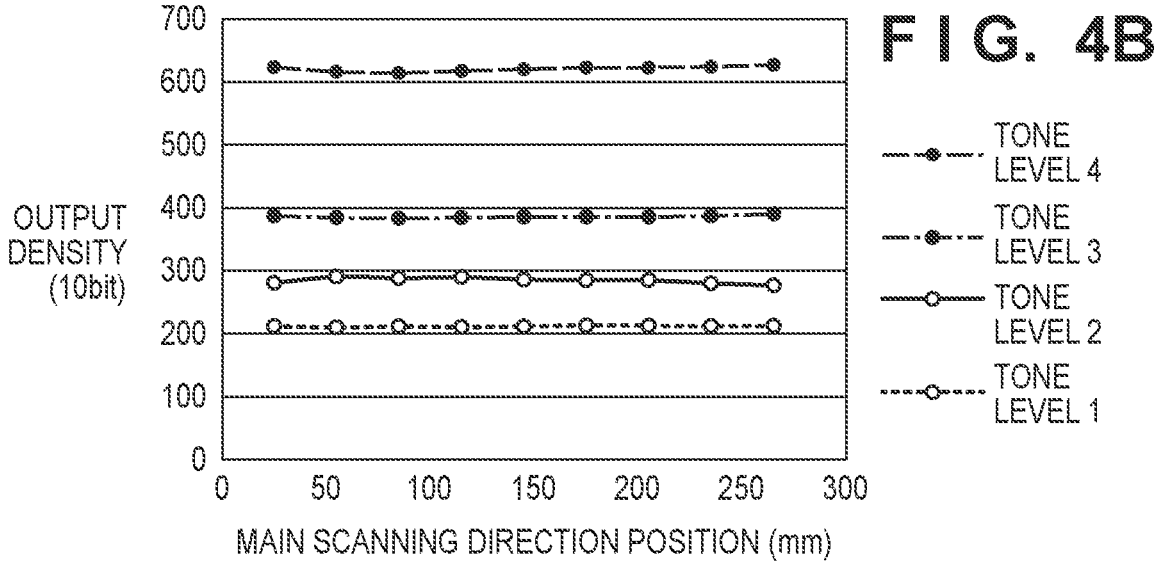
Figure 4C:
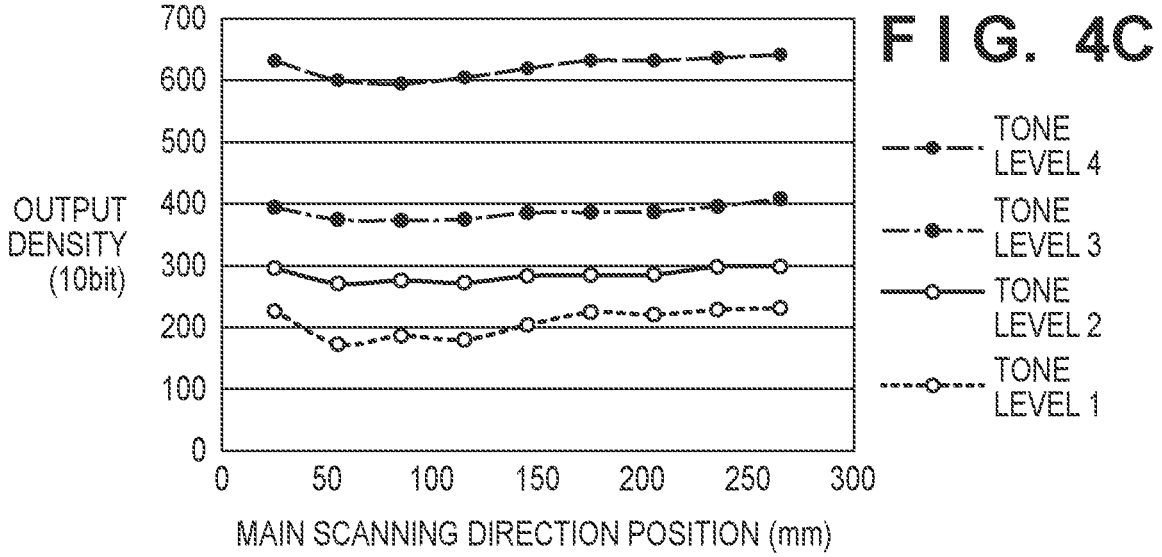

FIGS. 4A to 4C illustrate an example of a density distribution acquired by measurement using the measurement chart 30. These drawings, with the horizontal axis indicating positions in the main scanning direction and the vertical axis indicating density (output density) of the measured output image, illustrate the measurement result of density distribution for four tone levels (tone levels 1 to 4) corresponding to four different input image signal values.

FIG. 4A illustrates density distribution before correction, with density unevenness of density distribution appearing in the main scanning direction for each tone level. FIG. 4B illustrates an example of a measurement result of the corrected density distribution in a case where density unevenness correction has been performed using an appropriately set conversion coefficient N. In this example, an appropriate conversion coefficient N is set for each tone level. As a result, density unevenness has been suppressed in the main scanning direction in the output image for all the tone levels.

On the other hand, FIG. 4C illustrates an example of a measurement result of the corrected density distribution in a case where density unevenness correction has been performed using the conversion coefficient N which has been set to a larger value than the appropriate value. Here, the case where the conversion coefficient N is set larger corresponds to a case where a larger correction amount of the input image signal is required since the gradient of the tone characteristic of the printer unit 22 (FIG. 3) is small. In other words, the foregoing indicates that a larger correction amount of the input image signal is required in order to correct the output density to a desired density. However, for example, in a case where the tone characteristic of the printer unit 22 has varied when actually performing density unevenness correction, in comparison to when setting the conversion coefficient N (when determining the correction amount), the appropriate value of the conversion coefficient N has also varied. As a result, it may turn out that the correction amount of the input image signal cannot be derived using the appropriate conversion coefficient N, whereby the density unevenness may not be sufficiently corrected, as illustrated in FIG. 4C.

The conversion coefficient N used in density unevenness correction is set based on the relation between the input image signal and the density (output density) of the output image (i.e., tone characteristic of the printer unit 22). The tone characteristic varies not only when the engine state of the printer unit 22 varies, but also may vary depending on the type of sheet (paper) on which the measurement chart 30 for measuring density is printed even in the same engine state. This is because the state of toner applied on the sheet varies in accordance with characteristic values such as surface nature and basis weight of a sheet, whereby the density measurement value varies.

Therefore, in order to increase the accuracy of density unevenness correction, it is necessary to use the appropriate conversion coefficient N corresponding to the actual tone characteristic of the printer unit 22 when performing density unevenness correction. In the present embodiment, there will be described below an example of appropriately setting the conversion coefficient N in accordance with the tone characteristic of the printer unit 22 when performing density unevenness correction.

<Setting of Conversion Coefficient N>

Referring again to FIG. 2, the measurement chart 30 to be used in the image forming apparatus 10 will be described in more detail. The measurement chart 30 has a test image including a plurality of images (belt-like images) extending like a belt in the main scanning direction. The plurality of belt-like images have a constant width in the sub scanning direction orthogonal to the main scanning direction, and are arranged in parallel adjacent to each other in the sub scanning direction. In addition, each of the belt-like images is a single-color belt-like image formed across an image forming region in the main scanning direction, based on a uniform image signal value. Each of the belt-like images is therefore formed as an image with a uniform density unless density unevenness occurs. The width of each belt-like image in the sub scanning direction may be set within a range that allows for density measurement. As has been described above, the measurement chart 30 includes a plurality of belt-like images formed across an image forming region in the main scanning direction and arranged in parallel in the sub scanning direction orthogonal to the main scanning direction, the belt-like images respectively corresponding to different tone levels. The plurality of belt-like images corresponding to different tone levels correspond to a plurality of pattern images of different densities.

In the measurement chart 30 illustrated in FIG. 2, a plurality of belt-like image groups respectively including belt-like images of different colors (Y, M, C, K) are arranged in the sub scanning direction. The belt-like image groups respectively correspond to different tone levels. The measurement chart 30 of the present example includes four belt-like image groups respectively corresponding to four tone levels 1 to 4.

In the image forming apparatus 10, the printer unit 22 prints the measurement chart 30 on a sheet, and the density sensor unit 18 performs density measurement for the measurement chart 30 printed on the sheet. As a result, there is acquired a density profile for each of the four colors (Y, M, C, K), indicating a density distribution in the main scanning direction (distribution of output density values at respective positions in the main scanning direction) for the belt-like image for each tone level as illustrated in FIG. 4A. Here, FIG. 4A illustrates a density profile for C (cyan) as an example. As has been described above, each belt-like image is formed as an image with a uniform density unless density unevenness occurs. In this case, the density distribution indicated by the density profile turns out to be constant in the main scanning direction for each tone level. However, occurrence of density unevenness in the output image in the main scanning direction causes variation of the density distribution indicated by the density profile in the main scanning direction, as illustrated in FIG. 4A.

In the present embodiment, from the measurement result of the density profile, the correction amount of the input image signal is derived using the aforementioned conversion coefficient N in order to reduce such density unevenness. In order to increase the correction accuracy of the density unevenness, it is necessary to appropriately set the conversion coefficient N, as described above. In the following, setting of the conversion coefficient N will be described.

Figure 5A:
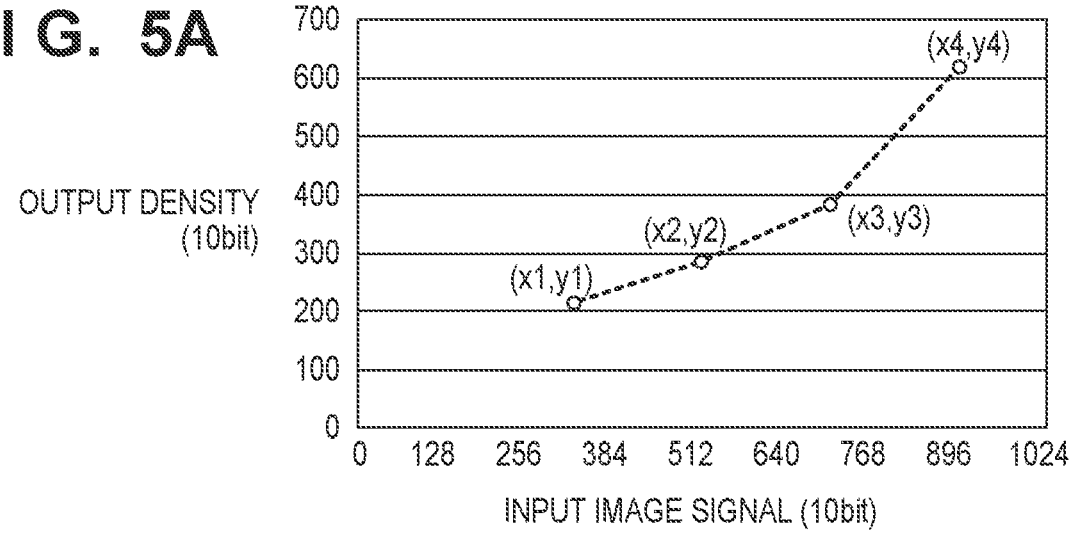
FIGS. 5A to 5C illustrate examples of a tone characteristic acquired based on a density measurement result.
Figure 5B:
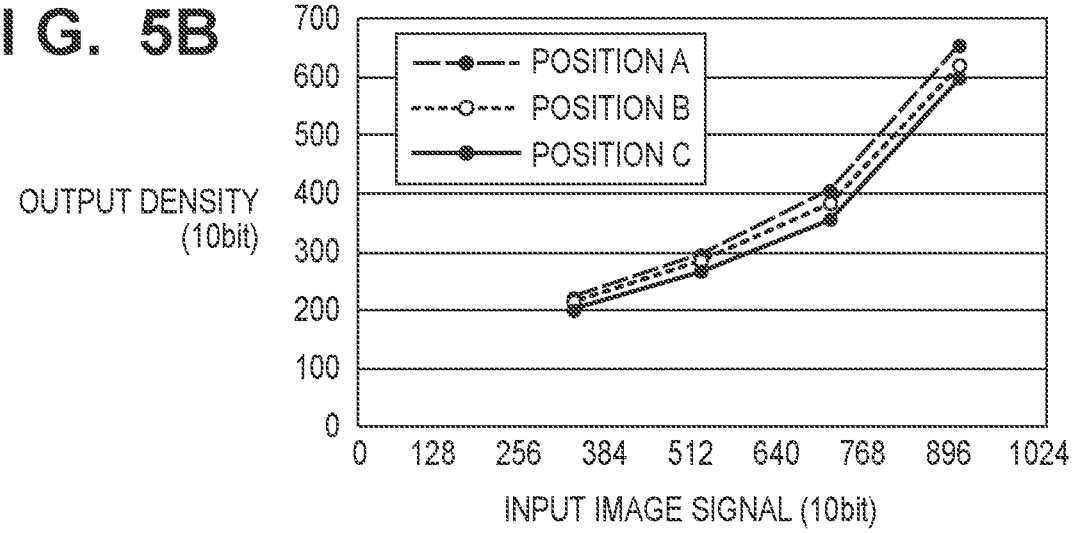

FIG. 5A illustrates an example of a tone characteristic indicating the relation between input image signals and output density acquired based on the result of density measurement for the measurement chart 30. For the tone characteristic, there is used an average value acquired by averaging the density values of respective positions (respective regions) in the main scanning direction for each tone level (for each of the tone levels 1 to 4). In the present example, the tone characteristic of the printer unit 22 is derived for each tone level using, as an example, an average value of densities in the main scanning direction. Note that, as illustrated in FIG. 5B, the tone characteristic may be derived for each different position (region) in the main scanning direction. In this case, setting of the conversion coefficient N described below is performed for each different position in the main scanning direction, using the tone characteristic for each different position in the main scanning direction.

In the present embodiment, the aforementioned conversion coefficient N is derived as follows, based on the relation between the input image signal and the output density (tone characteristic) illustrated in FIG. 5A.

First, a variation amount of the output density relative to the variation amount of the input image signal (i.e., gradient in the tone characteristic) is derived for each tone level corresponding to a different input image signal value. Here, letting x1 be the input image signal value and y1 be the output density value at a tone level 1, the density data indicating the measurement result of the output density for the tone level 1 is denoted (x1, y1). Similarly, density data for a tone level 2 is denoted (x2, y2), density data for a tone level 3 is denoted (x3, y3), and density data for a tone level 4 is denoted (x4, y4). In addition, density data for the density of the sheet itself is denoted (x0, y0). This output density y0 may be a measurement result of a part in which no image is actually formed on the sheet, or may be preliminarily registered as sheet information.

Figure 5C:
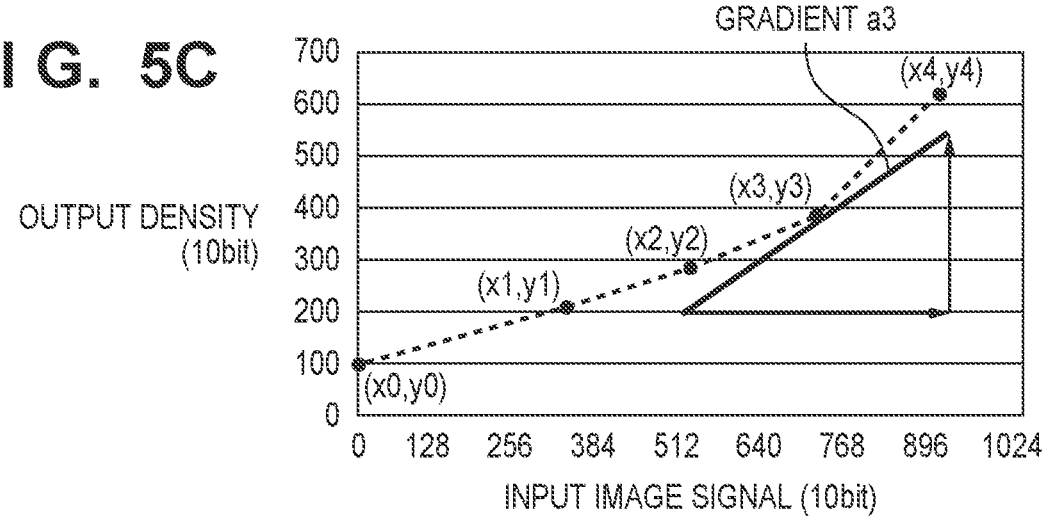

Next, in order to derive conversion coefficients N1 to N4 respectively corresponding to the tone levels 1 to 4, gradients a1 to a4 thereof in the vicinity of the tone levels 1 to 4 of the tone characteristic illustrated in FIG. 5A are derived. The gradient a1 may be derived by, for example, applying the least-squares method to density data of three points (x0, y0), (x1, y1) and (x2, y2) including the density data for the tone level 1. Similarly, the gradient a2 near the tone level 2 is derived using density data (x1, y1), (x2, y2) and (x3, y3). The gradient a3 near the tone level 3 is derived using density data (x2, y2), (x3, y3) and (x3, y4). The gradient a4 near the tone level 4 is derived using density data (x3, y3) and (x3, y4). FIG. 5C illustrates, as an example, the gradient a3 for the tone level 3 derived in the aforementioned manner.

Finally, the conversion coefficients N1 to N4 are derived as the reciprocal numbers of the gradients a1 to a4 corresponding to respective tone levels in the tone characteristic. FIG. 6 illustrates an example of the conversion coefficients N (N1 to N4) derived in the aforementioned manner. The gradients a1 to a4 of the tone characteristic indicate a variation amount of the output density relative to the variation amount of the input image signal for each corresponding tone level. The correction amount of the input image signal is derived by converting, using the conversion coefficients N1 to N4, according to equation (1), the density difference ΔD to be corrected for density unevenness correction. Therefore, it turns out that the conversion coefficients N1 to N4 are adjusted so that the smaller the variation amount of the output density relative to the variation amount of the input image signal in each of the tone levels, the larger the amount of correction of the density difference ΔD becomes. In addition, it turns out that the conversion coefficients N1 to N4 are adjusted so that the larger the variation amount of the output density relative to the variation amount of the input image signal, the smaller the amount of correction of the density difference ΔD becomes.

Note that, as illustrated in FIG. 5B, the density measurement value at each main scanning direction position is used for each tone level when deriving the tone characteristic for each position (region) in the main scanning direction, instead of using the average value of densities in the main scanning direction. In addition, the conversion coefficients N1 to N4 may be derived not only for each tone level, but also for each main scanning direction position.

<Processing Procedure>

Figure 7:
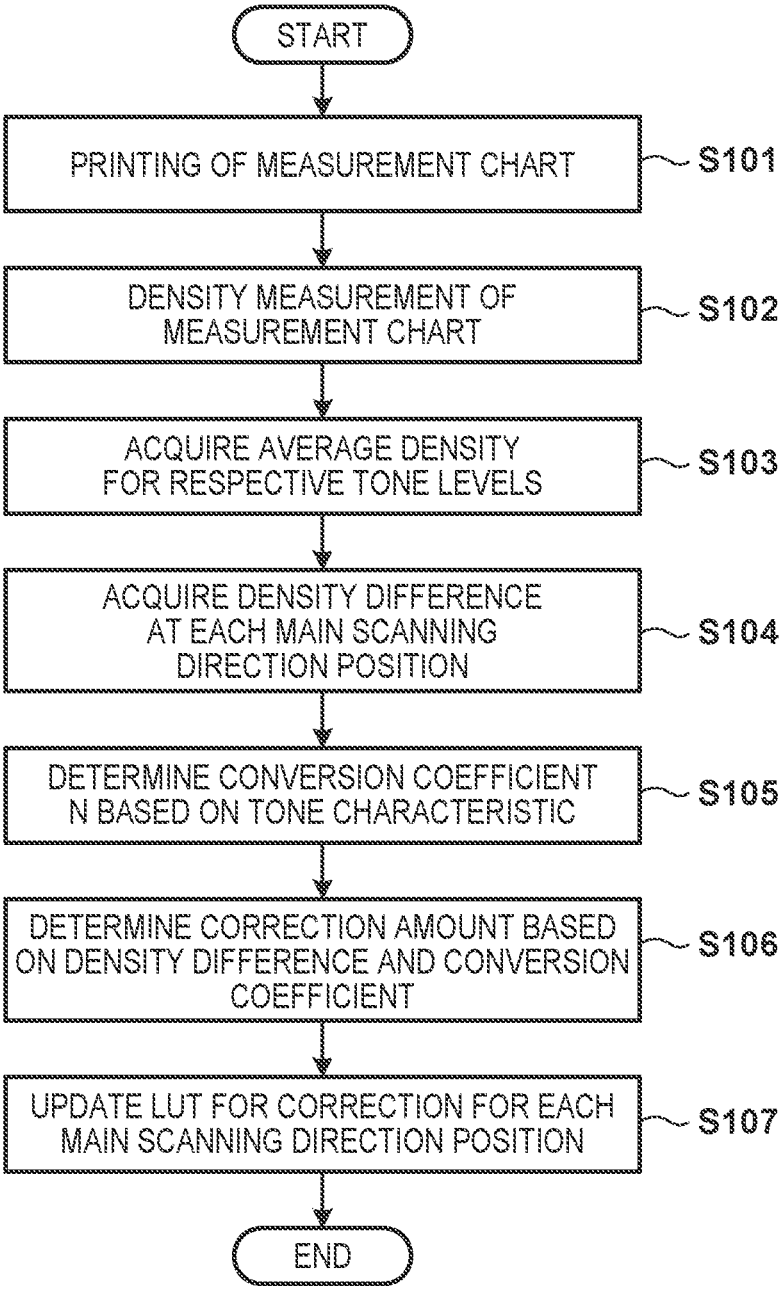
FIG. 7 is a flowchart illustrating a processing procedure for density unevenness correction.

FIG. 7 is a flowchart illustrating a processing procedure to be performed by CPU 11 in the image forming apparatus 10 for density unevenness correction in the main scanning direction. The processing at each step of FIG. 7 can be implemented in the image forming apparatus 10 by reading and executing, by the CPU 11, programs stored in a storage device such as the ROM 12.

First, at step S101, the CPU 11 controls the printer unit 22 to print the measurement chart 30 when a user provides, via the operation unit 17, an execution instruction of a correction process with regard to density unevenness. As illustrated in FIG. 2, the measurement chart 30 includes a plurality of belt-like images including a first belt-like image (first pattern image) and a second belt-like image (second pattern image) each having different densities.

Next, at step S102, using the density sensor unit 18 provided in the middle of the conveyance path, the CPU 11 performs density measurement of the measurement chart 30 during conveyance of a sheet on which the measurement chart 30 is printed. Specifically, the CPU 11 measures the density of the measurement chart 30 (density of each belt-like image on the measurement chart 30) formed on the sheet by the printer unit 22 at step S101. The CPU 11 acquires, as a result of the measurement, a density profile indicating the density distribution in the main scanning direction for each tone level. In the aforementioned manner, the CPU 11 causes the printer unit 22 to form a plurality of belt-like images (plurality of pattern images) including the first belt-like image (first pattern image) and the second belt-like image (second pattern image), and acquires results of reading the plurality of belt-like images by the density sensor unit 18 (results of reading the first belt-like image and the second belt-like image).

Note that measurement of the density of the measurement chart 30 may be performed using the scanner unit 20 instead of the density sensor unit 18. In this case, the user sets, to the scanner unit 20, the printing sheet on which the measurement chart 30 has been printed and discharged by the printer unit 22. Furthermore, the CPU 11 causes the line image sensor to read the measurement chart 30 printed on the printing sheet which has been set in the scanner unit 20, and measures the density of each patch based on the output of the line image sensor. On this occasion, there may be required a process that converts the RGB signal values output from the line image sensor into density values. Both the density sensor unit 18 and the scanner unit 20 function as a reading unit configured to read the measurement chart 30.

Next, at step S103, the CPU 11 acquires an average density value for each tone level based on the acquired density profile. Specifically, the CPU 11 acquires the average density value for each tone level by averaging, in the main scanning direction for each tone level, the density measurement values at each main scanning direction position included in the density profile.

Furthermore, at step S104, the CPU 11 acquires, for each tone level, the density difference ΔD to be corrected for density unevenness correction in the main scanning direction at each position in the main scanning direction, based on the measurement result with regard to the measurement chart 30. Specifically, the CPU 11 acquires as the density difference ΔD, for each tone level, the difference between the density measurement value at each main scanning direction position included in the density profile and the average density value acquired at step S103. In other words, the CPU 11 acquires, for each tone level, the density difference ΔD between the density measurement value at each main scanning direction position and the average density value.

Next, at step S105, the CPU 11 determines, according to the aforementioned method, the conversion coefficient N for each tone level (e.g., conversion coefficients N1 to N4 corresponding to tone levels 1 to 4), based on the tone characteristic of the printer unit 22 acquired from the measurement result of the measurement chart 30. As has been described above, in the present embodiment, the conversion coefficient N for each tone level to be used for generation of the plurality of conversion conditions at steps S106 to S107 is determined based on the tone characteristic of the printer unit 22 acquired from the measurement result of forming the measurement chart 30 on a sheet and measuring the density thereon. In the example described referring to FIGS. 5A to 5C, determination of the conversion coefficient N for each tone level is performed based on the gradients a1 to a4 indicating the variation amount of the density of the output image relative to the variation amount of the input image signal for each tone level in the tone characteristic of the printer unit 22. In the aforementioned manner, the conversion coefficient N (correction data) is generated, based on the reading results of the plurality of belt-like images (pattern images) included in the measurement chart 30.

Furthermore, at step S106, the CPU 11 determines the amount of correction of the input image signal for each tone level at each main scanning direction position. Specifically, the CPU 11 converts, in accordance with equation (1), the density difference ΔD for each tone level at each main scanning direction position into the correction amount of the input image signal, using the conversion coefficient N for each tone level. In the aforementioned manner, a plurality of conversion conditions are generated at step S107.

Finally, at step S107, the CPU 11 generates an LUT (lookup table) for each main scanning direction position, associating input image signal values corresponding to respective tone levels and corrected image signal values (output image signal values), and updates the LUT. The LUT corresponds to conversion conditions for converting input image data (input image signals) for correcting density unevenness that occurs during image formation by the printer unit 22. The LUT for each position in the main scanning direction is held in a storage device such as the RAM 13 or the non-volatile memory 14, and updated at step S107 each time processing is performed according to the procedure illustrated in FIG. 7. Subsequently, the CPU 11 terminates the processing according to the procedure illustrated in FIG. 7.

As has been described above, in the present embodiment, the image forming apparatus 10 measures the density of the measurement chart 30 and acquires, for each tone level, the density difference ΔD to be corrected for density unevenness correction in the main scanning direction at each position in the main scanning direction, based on the measurement result. The image forming apparatus 10 generates a plurality of conversion conditions by converting the density difference ΔD for each tone level at each position in the main scanning direction into an amount of correction of the input image signal, using the conversion coefficient N for each tone level. Furthermore, the image forming apparatus 10 corrects the input image data, based on the plurality of generated conversion conditions. In addition, the conversion coefficient N for each tone level is determined based on the tone characteristic of the printer unit 22 acquired from the measurement result with regard to the measurement chart 30.

According to the present embodiment, the conversion coefficient N for each tone level to be used for generation of the plurality of conversion conditions is determined based on the tone characteristic of the printer unit 22, that is acquired from the measurement result of forming the measurement chart 30 on a sheet and measuring the density thereon. Furthermore, density unevenness correction is performed using the determined conversion coefficient N. In the aforementioned manner, the conversion coefficient N is determined based on the tone characteristic acquired at the timing of density unevenness correction, whereby a plurality of conversion conditions are generated. As a result, the correction accuracy of the density unevenness does not decrease due to variation of the tone characteristic between the timing of generating the plurality of conversion conditions and the timing of actually performing correction of density unevenness using the plurality of conversion conditions. Accordingly, by virtue of the present embodiment, it is possible to perform the correction process of density unevenness using the plurality of conversion conditions generated using the appropriate conversion coefficient N, and therefore it is possible to improve the correction accuracy in the correction process.

<Review of First Embodiment>

In the present embodiment, the CPU 11 of the image forming apparatus 10 functions as an example of the control unit configured to cause the printer unit 22 to form a first pattern image and a second pattern image having a different density from that of the first pattern image. The CPU 11 further functions as an example of the acquisition unit configured to acquire the results of reading the plurality of pattern images (the result of reading the first pattern image and the result of reading the second pattern image) by the density sensor unit 18.

In the present example, the CPU 11 further functions as an example of a generation unit configured to generate, based on the results of reading the plurality of pattern images (the result of reading the first pattern image and the result of reading the second pattern image), a plurality of conversion conditions corresponding to a plurality of positions in the main scanning direction (predetermined direction) orthogonal to the rotation direction of the photosensitive drum. Specifically, the CPU 11 generates correction data (conversion coefficient N) based on the result of reading the first pattern image and the result of reading the second pattern image. Furthermore, the CPU 11 generates a first conversion condition based on a target value corresponding to the first pattern image, a first read value of the first pattern image, corresponding to a first position in the predetermined direction (main scanning direction), a target value corresponding to the second pattern image, a second read value of the second pattern image, corresponding to the first position in the predetermined direction, and the correction data. In addition, the CPU 11 generates a second conversion condition based on the target value corresponding to the first pattern image, a third read value of the first pattern image, corresponding to a second position in a predetermined direction, the target value corresponding to the second pattern image, a fourth read value corresponding to the second position in the predetermined direction, and the correction data.

The CPU 11 may determine the target value of the first pattern image from a plurality of read values of the first pattern image in the main scanning direction (predetermined direction), and determine the target value of the second pattern image from the plurality of read values of the second pattern image in the predetermined direction. In addition, the plurality of conversion conditions may be provided as a lookup table (LUT) for converting input image signal values of the image data into output image signal values.

Performing the density unevenness correction process (conversion of input image data) using the plurality of conversion conditions generated in the aforementioned manner allows for suppressing density unevenness with a high accuracy.

Second Embodiment

In the first embodiment, the tone characteristic indicating the relation between the input image signal and the output density is acquired based on the measurement result of the density with regard to the measurement chart 30, and the conversion coefficient N to be applied to the density difference ΔD to be corrected is determined based on the tone characteristic. As has been described above, the tone characteristic may also vary depending on the type of sheet (paper) on which the measurement chart 30 for density unevenness correction is printed. Therefore, in a second embodiment, in association with the types of sheet used for density unevenness correction, a plurality of conversion coefficient tables is preliminarily prepared, each including the conversion coefficients N corresponding to a plurality of tone levels. When performing density unevenness correction, there is used a conversion coefficient table corresponding to the type of sheet to be used. In the following, description will be provided focusing on description different from the first embodiment, omitting the description common with the first embodiment.

A sheet to be used for density unevenness correction is preliminarily set on a feeding unit such as a feeding cassette of the image forming apparatus 10. Sheet information such as type of the sheet is held in a storage device such as the RAM 13 or the non-volatile memory 14, in association with the feeding unit having the sheet stored therein. The sheet information can be set by the user via the operation unit 17, which is the user interface (UI) of the image forming apparatus 10. The type of sheet includes normal paper, thick paper, coated paper, or the like. Coated paper is different from normal paper and thick paper in terms of surface nature. Thick paper is different from normal paper in terms of basis weight.

When performing density unevenness correction, the CPU 11 identifies the type of sheet by referring to the sheet information held in the storage device, and uses a conversion coefficient table corresponding to the specified type. Each of the conversion coefficients N included in the conversion coefficient table is preliminarily determined as illustrated in FIGS. 8A to 8C by acquiring, for each type of sheet, a tone characteristic indicating the relation between the input image signal and the output density. The conversion coefficient tables including the conversion coefficients N determined for each type of sheet are preliminarily stored in a storage device such as the RAM 13 or the non-volatile memory 14, in association with the type of sheet. In other words, the storage device has stored therein, for each type of sheet, information indicating the preliminarily determined conversion coefficients N for each tone level.

Note that the conversion coefficient tables may be preliminarily determined based on, for example, a result of consideration by the developer of the image forming apparatus 10. Alternatively, as in the first embodiment, the conversion coefficient tables may be determined by printing the measurement chart 30 and measuring its density, and may be stored in association with the types of sheet used for printing the measurement chart 30.

Figure 9:
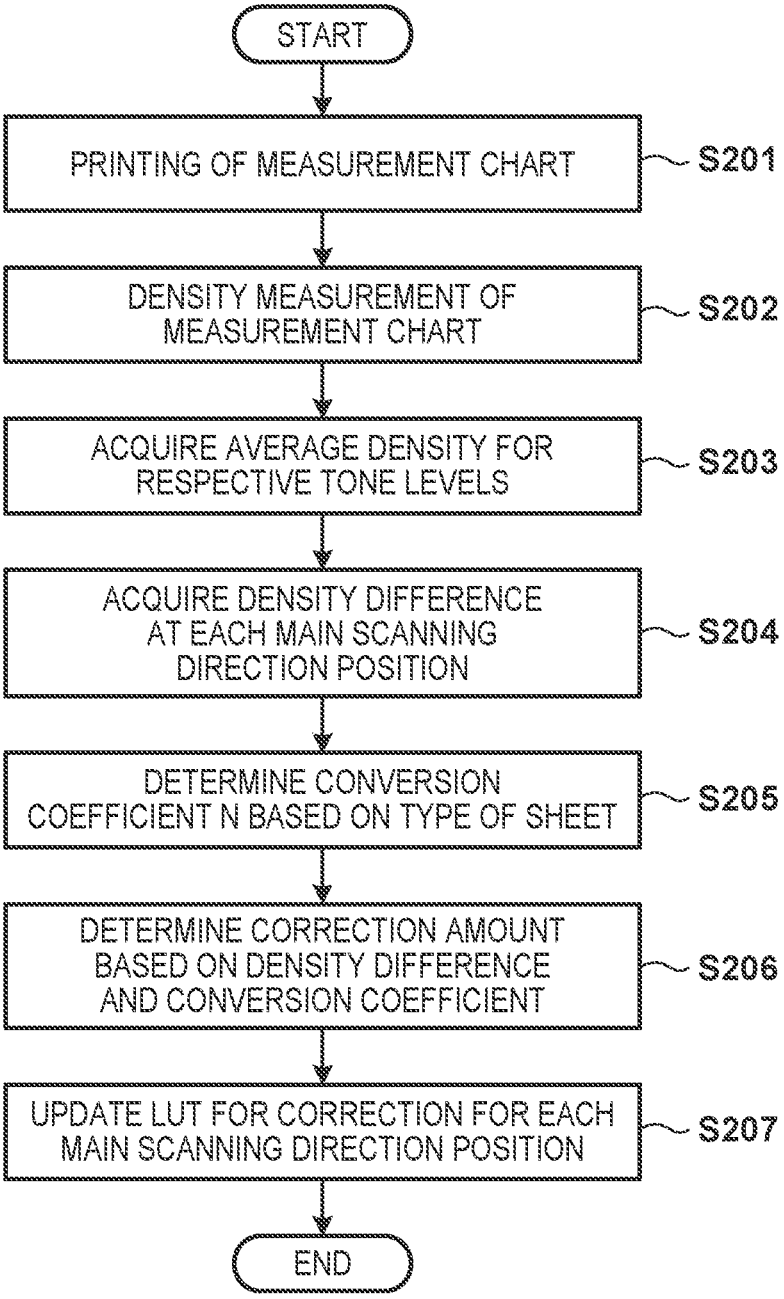
FIG. 9 is a flowchart illustrating a processing procedure for density unevenness correction according to the second embodiment.

FIG. 9 is a flowchart illustrating a processing procedure to be performed by the CPU 11 in the image forming apparatus 10 for density unevenness correction in the main scanning direction. The processing at each step of FIG. 9 can be implemented in the image forming apparatus 10 by reading and executing, by the CPU 11, programs stored in a storage device such as the ROM 12.

At steps S201 to S204, there is performed processing similar to steps S101 to S104 in the first embodiment. Upon completion of the processing at step S204, the CPU 11 advances the process to step S205.

At step S205, the CPU 11 identifies the type of sheet used, based on the print setting for printing the measurement chart 30 or based on sheet information held in the storage device in association with the feeding unit that turned out to be the feeding source at step S201. Furthermore, the CPU 11 determines the conversion coefficient N for each tone level to be used for generating a plurality of conversion conditions to be applied to input image data (input image signals), by acquiring, from the storage device, a conversion coefficient table corresponding to the identified type of sheet. Furthermore, at step S206, the CPU 11 applies the conversion coefficient N corresponding to each tone level to the density difference ΔD at each main scanning direction position, in accordance with equation (1), similarly to step S105 of the first embodiment. As a result, the correction amount for each tone level relative to the input image signal at each main scanning direction position is determined.

Finally, at step S207, the CPU updates, similarly to the first embodiment, the LUT (lookup table) in which the input image signal value corresponding to each tone level at each of the main scanning direction positions is associated with the corrected image signal value. Subsequently, the CPU 11 terminates the processing according to the procedure illustrated in FIG. 9.

As has been described above, in the present embodiment, the conversion coefficient table including the conversion coefficients N of respective tone levels to be used in density unevenness correction is determined according to the type of sheet used for printing the measurement chart 30. The conversion coefficients N for respective tone levels are determined according to the type of sheet used in the measurement with regard to the measurement chart 30. As a result, it is possible to determine the appropriate conversion coefficient N in accordance with the output density characteristic of the printer unit 22 that may vary depending on the type of sheet to be used, and perform density unevenness correction. Therefore, by virtue of the present embodiment, it is possible to perform the correction process of density unevenness using the plurality of conversion conditions generated using the appropriate conversion coefficient N, and therefore it is possible to improve the correction precision in the correction process.

In addition, although the density sensor unit 18 of the first and second embodiments is configured to measure the density of the measurement chart 30, there may be a configuration that uses a sensor to measure the luminance of the measurement chart 30 instead of the density sensor unit 18. Both the voltage value output from the density sensor unit 18 and the output value of the sensor measuring the luminance correspond to the read value of the measurement chart 30. Furthermore, although the CPU 11 is configured to generate the LUT based on the density difference ΔD, it may be configured to generate the LUT based on the luminance difference ΔL instead of the density difference ΔD.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-053142, filed Mar. 24, 2020, which is hereby incorporated by reference herein in its entirety.

What is claimed is:

1. An image forming apparatus, comprising:

an image forming unit that includes:

a photosensitive member that rotates;

a charging unit configured to charge the photosensitive member;

an exposure unit configured to expose the photosensitive member charged by the charging unit to form an electrostatic latent image on the photosensitive member; and a developing unit configured to develop the electrostatic latent image on the photosensitive member;

an image processing unit configured to convert image data based on a plurality of conversion conditions corresponding to a plurality of positions in a predetermined direction orthogonal to a rotation direction of the photosensitive member;

a reading unit configured to read a pattern image formed on a sheet; and a controller configured to:

control the image forming unit to form an image based on the image data converted by the image processing unit;

control the image forming unit to form a plurality of pattern images including a first pattern image, a second pattern image, and a third pattern image, wherein the first pattern image corresponds to a first tone level, the second pattern image corresponds to a second tone level different from the first tone level, and the third pattern image corresponds to a third tone level different from both of the first tone level and the second tone level;

control the reading unit to read the plurality of pattern images on the sheet;

determine respective density profiles for the plurality of pattern images based on a reading result of the plurality of pattern images by the reading unit, wherein the density profiles include data concerning densities corresponding to the plurality of positions in the predetermined direction; and generate the plurality of conversion conditions based on the density profiles, target density data for each tone level, and a generation condition for each tone level.

2. The image forming apparatus according to claim 1, wherein the plurality of conversion conditions are provided as a lookup table for converting an input image signal value of the image data into an output image signal value.

3. The image forming apparatus according to claim 1, wherein the controller determines the generation condition for each tone level based on the reading result of the plurality of pattern images by the reading unit.

4. The image forming apparatus according to claim 1, wherein the controller determines the generation condition for each tone level based on the reading result of the plurality of pattern images by the reading unit, and the controller determines a generation condition for the first tone level by a least-squares method using a density profile for the first pattern image and a density profile for a pattern image that is included in the plurality of pattern images and is other than the first pattern image.

5. The image forming apparatus according to claim 1, wherein a generation condition for the first tone level includes a first generation condition corresponding to each of the plurality of positions, a generation condition for the second tone level includes a second generation condition corresponding to each of the plurality of positions, and a generation condition for the third tone level includes a first generation condition corresponding to each of the plurality of positions.

6. The image forming apparatus according to claim 1, wherein the controller determines the target density data for each tone level based on the reading result of the plurality of pattern images by the reading unit.

* * * * *